US010456838B2

(12) United States Patent
Choi et al.

(10) Patent No.: US 10,456,838 B2
(45) Date of Patent: Oct. 29, 2019

(54) METHOD FOR PRODUCING METAL NANOPARTICLES

(71) Applicant: LG CHEM, LTD., Seoul (KR)

(72) Inventors: Ran Choi, Daejeon (KR); Kwanghyun Kim, Daejeon (KR); Jungup Bang, Daejeon (KR); Sang Hoon Kim, Daejeon (KR); Gyo Hyun Hwang, Daejeon (KR); Jun Yeon Cho, Daejeon (KR)

(73) Assignee: LG CHEM, LTD., Seoul (KR)

( * ) Notice: Subject to any disclaimer, the term of this patent is extended or adjusted under 35 U.S.C. 154(b) by 375 days.

(21) Appl. No.: 15/502,918

(22) PCT Filed: Aug. 13, 2015

(86) PCT No.: PCT/KR2015/008497

§ 371 (c)(1),
(2) Date: Feb. 9, 2017

(87) PCT Pub. No.: WO2016/024830

PCT Pub. Date: Feb. 18, 2016

(65) Prior Publication Data

US 2017/0232522 A1 Aug. 17, 2017

(30) Foreign Application Priority Data

Aug. 14, 2014 (KR) ..... 10-2014-0106082

(51) Int. Cl.
*B22F 9/24* (2006.01)
*B22F 1/00* (2006.01)

(52) U.S. Cl.
CPC ..... *B22F 9/24* (2013.01); *B22F 1/0018* (2013.01); *B22F 2001/0037* (2013.01); *B22F 2009/245* (2013.01); *B22F 2301/15* (2013.01); *B22F 2301/25* (2013.01); *B22F 2304/054* (2013.01); *B22F 2998/10* (2013.01)

(58) Field of Classification Search
CPC .. B22F 9/24; B22F 1/0018; B22F 2001/0037; B22F 2009/245; B22F 2304/054; B22F 2301/25; B22F 2301/15; B22F 2998/10
See application file for complete search history.

(56) References Cited

U.S. PATENT DOCUMENTS

| | | | |
|---|---|---|---|
| 6,752,979 | B1 | 6/2004 | Talbot et al. |
| 9,698,429 | B2 | 7/2017 | Kim et al. |
| 2009/0213369 | A1 | 8/2009 | Lee et al. |

(Continued)

FOREIGN PATENT DOCUMENTS

| | | |
|---|---|---|
| CN | 102179525 | 9/2011 |
| CN | 102554262 | 7/2012 |

(Continued)

OTHER PUBLICATIONS

"Silver Nano Bowl, Preparation of Nano-Cage and Hollow Porous Nanosheets," English Language Abstract on pp. 4-5, (2010) 76 pages.

(Continued)

*Primary Examiner* — Anthony J Zimmer
(74) *Attorney, Agent, or Firm* — Dentons US LLP

(57) ABSTRACT

The present specification relates to a method for preparing a metal nanoparticle.

21 Claims, 6 Drawing Sheets

(56) References Cited

U.S. PATENT DOCUMENTS

| | | | | |
|---|---|---|---|---|
| 2010/0155310 | A1* | 6/2010 | Enomura | B01F 3/0807 209/668 |
| 2010/0258759 | A1 | 10/2010 | Archer et al. | |
| 2011/0052671 | A1 | 3/2011 | Zasadzinski et al. | |
| 2011/0311635 | A1 | 12/2011 | Stucky et al. | |
| 2012/0015211 | A1 | 1/2012 | Gu et al. | |
| 2012/0133483 | A1 | 5/2012 | Zatloukal et al. | |
| 2012/0321897 | A1 | 12/2012 | Yang et al. | |
| 2014/0308537 | A1 | 10/2014 | Cho et al. | |
| 2015/0299758 | A1 | 10/2015 | Yasuda et al. | |
| 2017/0084924 | A1 | 3/2017 | Li et al. | |

FOREIGN PATENT DOCUMENTS

| | | |
|---|---|---|
| CN | 102674236 | 9/2012 |
| CN | 103857484 | 6/2014 |
| JP | 200645582 | 2/2006 |
| KR | 10-2009-0123404 | 12/2009 |
| KR | 10-2011-0040006 | 4/2011 |
| KR | 10-2012-0115849 | 10/2012 |
| KR | 10-1279640 | 6/2013 |
| WO | 2013069732 | 5/2013 |

OTHER PUBLICATIONS

Sun et al., "Double-layered NiPt nanobowls with ultrathin shell synthesized in water at room temperature," CrystEngComm 14(16): 5151-5154 (2012).

Zhou et al., "Pt/Pd alloy nanoparticles composed of bimetallic nanobowls: Synthesis, characterization and electrocatalytic activites," Electrochimica Acta 55(27): 8111-8115 (2010).

Kim et al., "Facile fabrication of hollow Pt/Ag nanocomposites having enhanced catalytic properties," Applied Catalysis B: Environmental 103(1): 253-260 (2011).

Zhao et al., "Methanol electro-oxidation on Ni@Pd core-shell nanoparticles supported on multi-walled carbon nanotubes in alkaline media," International Journal of Hydrogen Energy 35(8): 3249-3257 (2010).

* cited by examiner

[Figure 1]
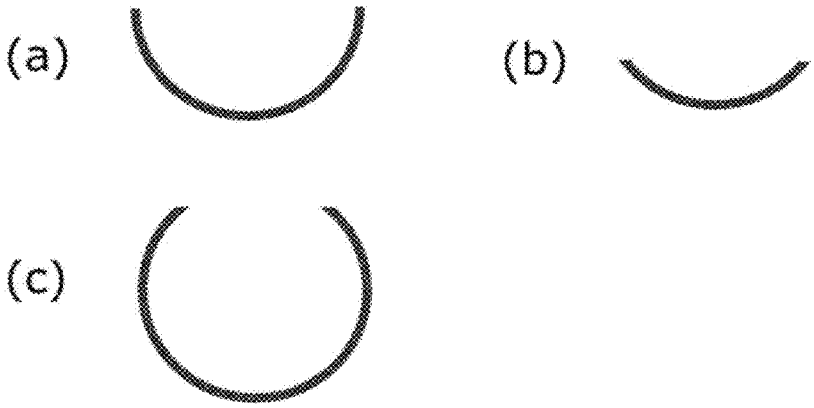
[Figure 2]
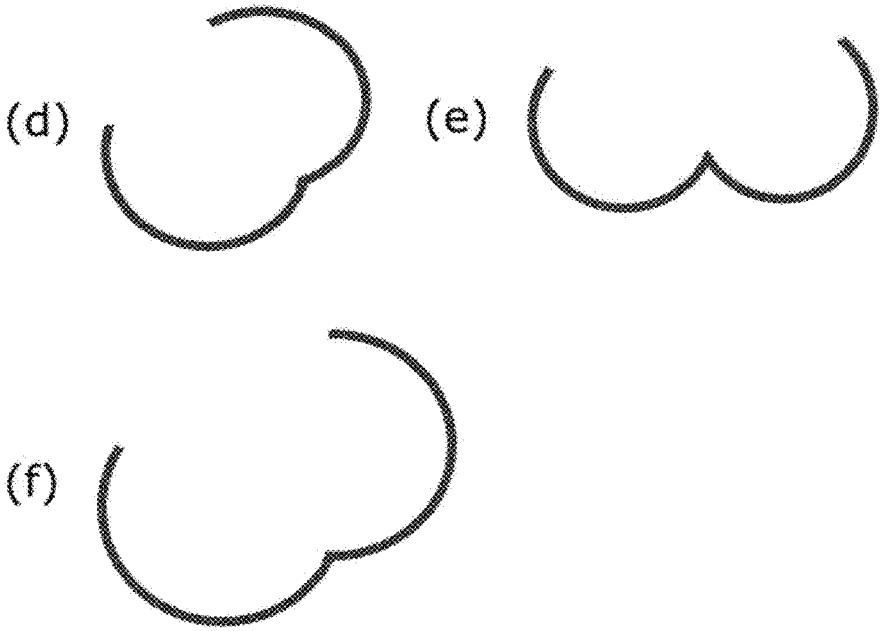

[Figure 3]
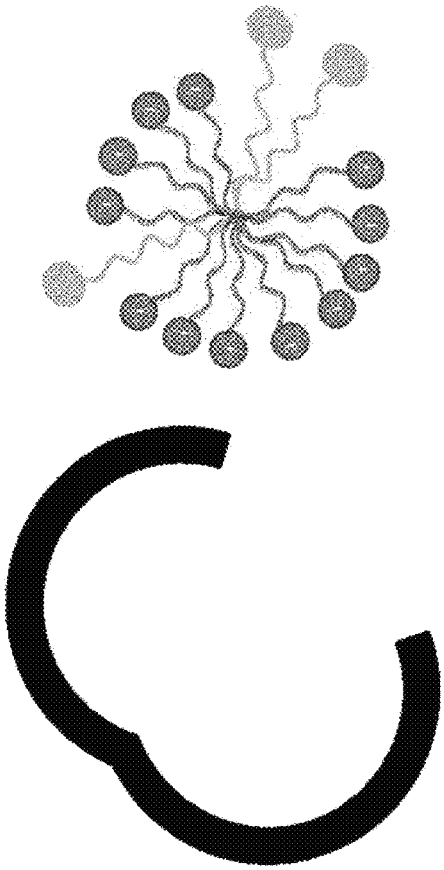

[Figure 4]
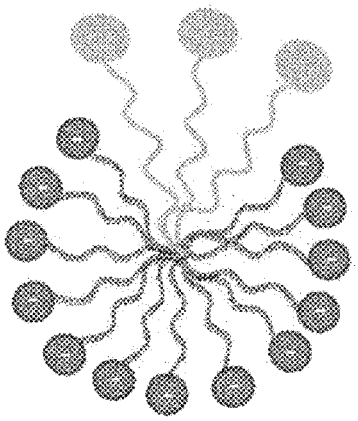
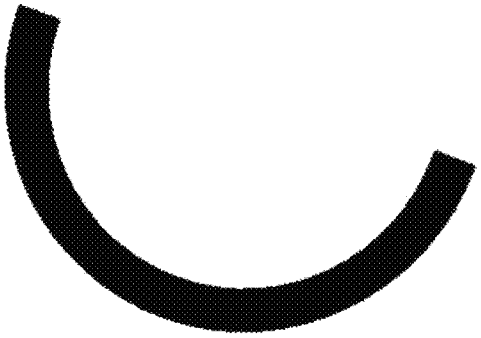

[Figure 5]
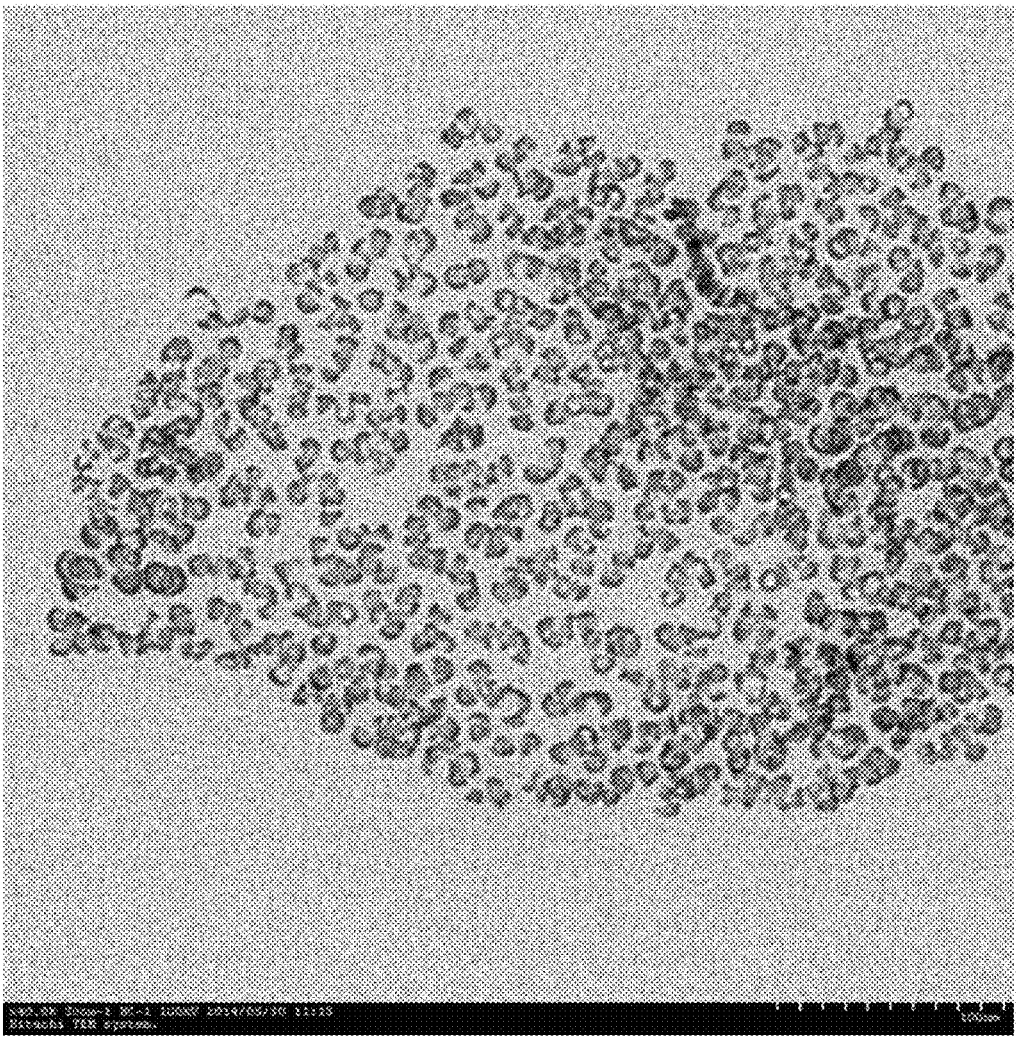

[Figure 6]
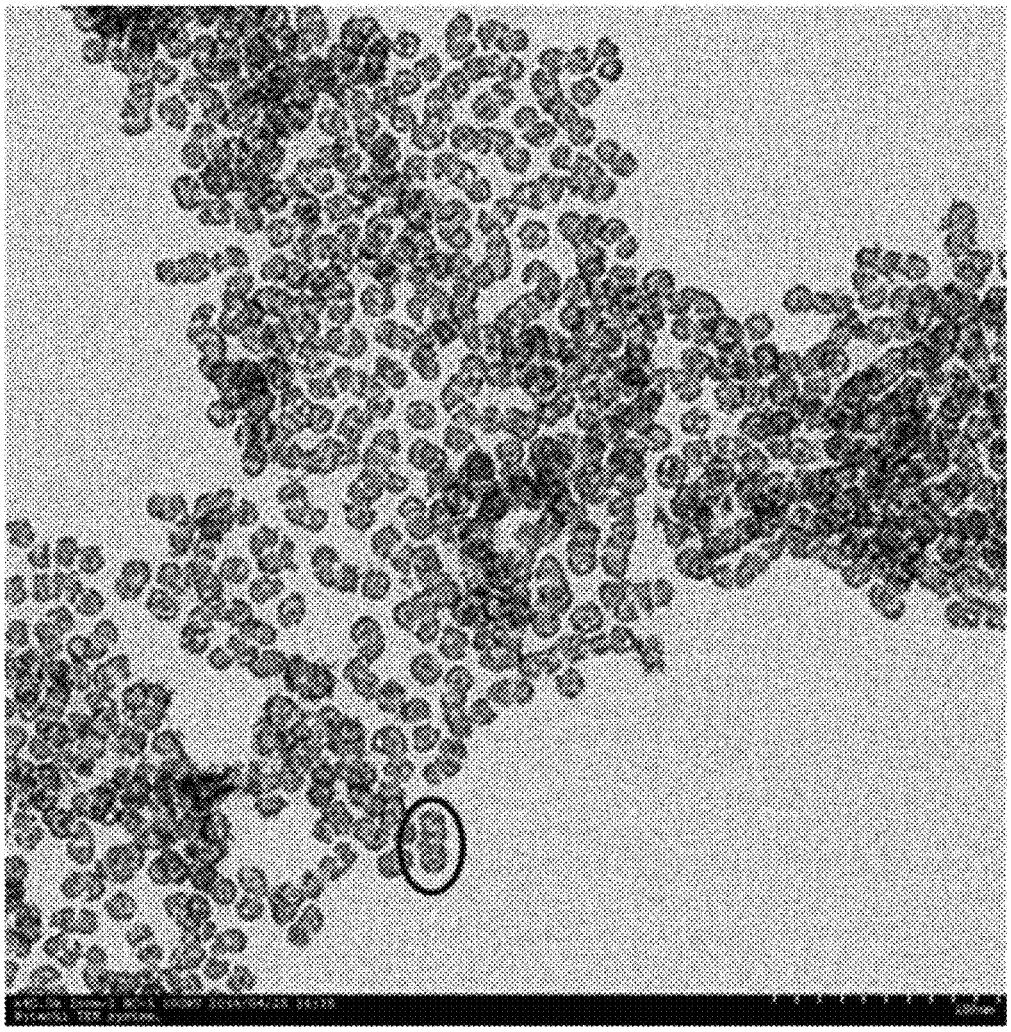

[Figure 7]
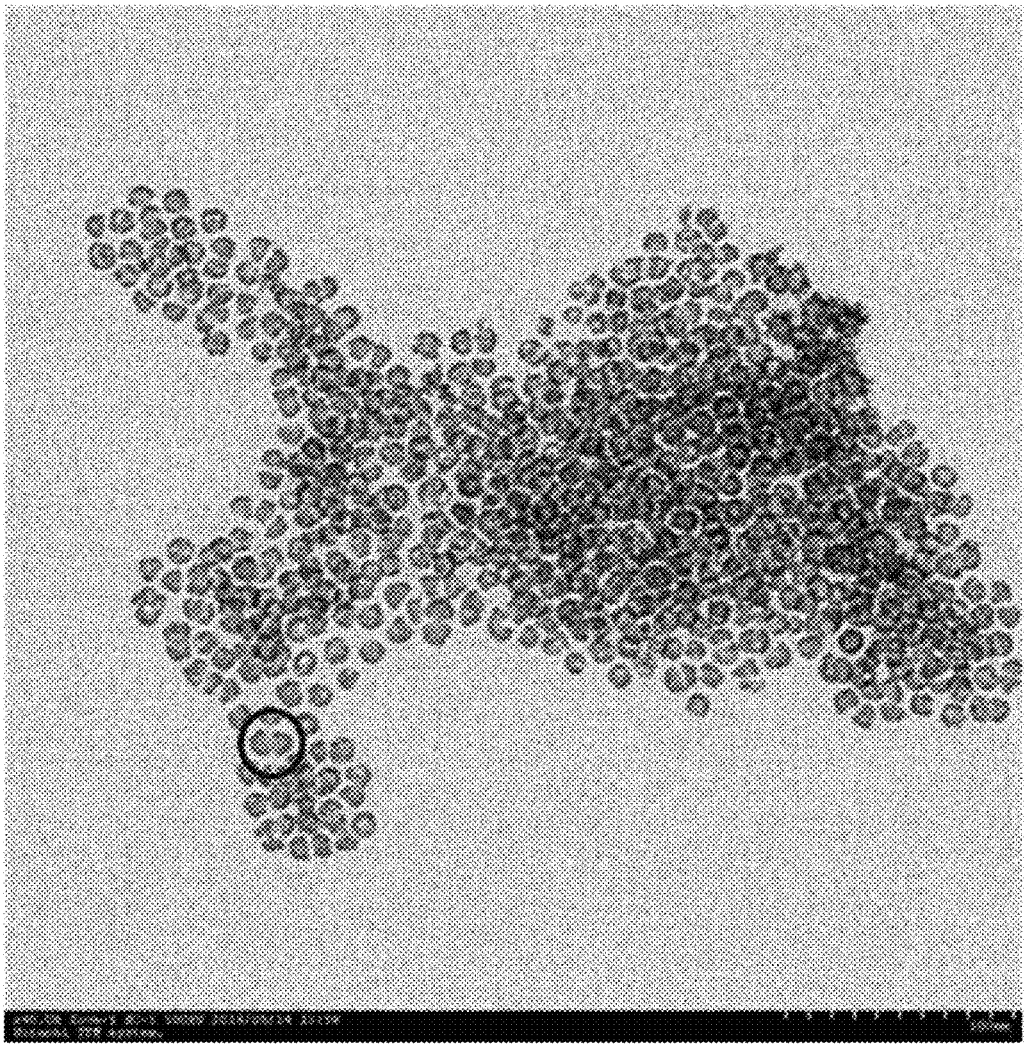

METHOD FOR PRODUCING METAL NANOPARTICLES

This application is a National Stage Entry of International Application No. PCT/KR2015/008497, filed Aug. 13, 2015, and claims the benefit of and priority to Korean Application No. KR 10-2014-0106082, filed on Aug. 14, 2014, all of which are hereby incorporated by reference in their entirety for all purposes as if fully set forth herein.

TECHNICAL FIELD

This application claims priority to and the benefit of Korean Patent Application No. 10-2014-0106082 filed in the Korean Intellectual Property Office on Aug. 14, 2014, the entire contents of which are incorporated herein by reference.

The present specification relates to a method for preparing a metal nanoparticle.

BACKGROUND ART

Nanoparticles are particles having nanoscale particle sizes, and show optical, electrical and magnetic properties completely different from those of bulk materials due to a large specific surface area and the quantum confinement effect, in which energy required for electron transfer changes depending on the size of material. Accordingly, due to such properties, much interest has been concentrated on their applicability in the catalytic, electromagnetic, optical, medical fields, and the like.

Nanoparticles may be considered as intermediates between bulks and molecules, and may be synthesized in terms of two approaches, that is, the "top-down" approach and the "bottom-up" approach.

Examples of a method for synthesizing a metal nanoparticle include a method for reducing metal ions in a solution by using a reducing agent, a method for synthesizing a metal nanoparticle using gamma-rays, an electrochemical method, and the like, but in the existing methods, it is difficult to synthesize nanoparticles having a uniform size and shape, or it is difficult to economically mass-produce high-quality nanoparticles for various reasons such as problems of environmental contamination, high costs, and the like by using organic solvents.

CITATION LIST

Official Gazette of Korean Patent Application Laid-Open No. 10-2008-0097801

DETAILED DESCRIPTION OF THE INVENTION

Technical Problem

The present specification has been made in an effort to provide a method for preparing a metal nanoparticle.

Technical Solution

An exemplary embodiment of the present specification provides a method for preparing a metal nanoparticle, the method including: forming a solution including a solvent, a metal salt which provides a metal ion or an atomic group ion including the metal ion in the solvent, one or more surfactants which form micelles in the solvent, an amino acid, and a halide; and forming the metal nanoparticle by adding a reducing agent to the solution, in which the metal nanoparticle includes one or more bowl-type particles including one or more metals.

Advantageous Effects

The method for preparing a metal nanoparticle according to an exemplary embodiment of the present specification is advantageous in that it is possible to mass-produce metal nanoparticles having a uniform size of several nanometers, there is a cost reduction effect, and no environmental pollution is generated in the preparation process. Furthermore, according to the method for preparing a metal nanoparticle according to the present specification, it is possible to prepare a metal nanoparticle which has enhanced activity due to a large specific surface area.

BRIEF DESCRIPTION OF DRAWINGS

FIG. 1 illustrates examples of the cross-section of the bowl-type particle of the present specification.

FIG. 2 illustrates examples of the cross-section of a metal nanoparticle in a form in which two bowl-type particles of the present specification are partially brought into contact with each other.

FIGS. 3 and 4 illustrate examples of the cross-section of the metal nanoparticle formed by the preparation method of the present specification.

FIG. 5 illustrates a transmission electron microscope (TEM) image of the metal nanoparticles prepared according to Example 1.

FIG. 6 illustrates a transmission electron microscope (TEM) image of the metal nanoparticles prepared according to Comparative Example 1.

FIG. 7 illustrates a transmission electron microscope (TEM) image of the metal nanoparticles prepared according to Comparative Example 2.

BEST MODE

When one part "includes" one constituent element in the present specification, unless otherwise specifically described, this does not mean that another constituent element is excluded, but means that another constituent element may be further included.

Hereinafter, the present specification will be described in more detail.

An exemplary embodiment of the present specification provides a method for preparing a metal nanoparticle, the method including: forming a solution including a solvent, a metal salt which provides a metal ion or an atomic group ion including the metal ion in the solvent, one or more surfactants which form micelles in the solvent, an amino acid, and a halide; and forming the metal nanoparticle by adding a reducing agent to the solution, in which the metal nanoparticle includes one or more bowl-type particles including one or more metals.

The bowl type in the present specification may mean that at least one curved line region is included on the cross section. Alternatively, the bowl type may mean that a curved line region and a straight line region are mixed on the cross section. Alternatively, the bowl type may be a semispherical shape, and the semispherical shape may not be necessarily a form in which the particle is divided such that the division line passes through the center of the sphere, but may be a form in which one region of the sphere is removed. Furthermore, the spherical shape does not mean only a perfect spherical shape, and may include a roughly spherical shape. For example, the outer surface of the sphere may not be smooth, and the radius of curvature of the sphere may not be constant.

Alternatively, the bowl-type particle of the present specification may mean that a region corresponding to a 30% to 80% of the hollow nanoparticle is not continuously formed. Alternatively, the bowl-type particle of the present specification may mean that a region corresponding to a 30% to 80% of the entire shell portion of the hollow nanoparticle is not continuously formed.

FIG. 1 illustrates examples of the cross-section of the bowl-type particle according to the present specification.

According to an exemplary embodiment of the present specification, the metal nanoparticle may be composed of the one or two bowl-type particles.

Specifically, according to an exemplary embodiment of the present specification, the metal nanoparticle may be composed of the one bowl-type particle. In this case, the cross-section of the metal nanoparticle may be one of the cross-sections illustrated in FIG. 1.

According to an exemplary embodiment of the present specification, the metal nanoparticle may be in a form in which the two bowl-type particles are partially brought into contact with each other.

The metal nanoparticle of the present specification in the form in which the two bowl-type particles are partially brought into contact with each other may be in a form in which a portion of the hollow nanoparticle is split.

FIG. 2 illustrates examples of the cross-section of a metal nanoparticle in a form in which the two bowl-type particles of the present specification are partially brought into contact with each other.

According to an exemplary embodiment of the present specification, the region where the bowl-type particles are partially brought into contact with each other may include a region where the slope of the tangent line is reversed.

According to an exemplary embodiment of the present specification, the preparation method may include a method in which a hollow core is formed inside of the metal nanoparticle.

In the present specification, the hollow means that the core portion of the metal nanoparticle is empty. Further, the hollow may be used as the same meaning as a hollow core.

According to an exemplary embodiment of the present specification, the hollow may include a space in which the internal material is not present by 50 vol % or more, specifically 70 vol % or more, and more specifically 80 vol % or more. Alternatively, the hollow may also include a space of which the inside is empty by 50 vol % or more, specifically 70 vol % or more, and more specifically 80 vol % or more. Alternatively, the hollow may include a space having an internal porosity of 50 vol % or more, specifically 70 vol % or more, and more specifically 80 vol % or more.

The method for preparing a metal nanoparticle according to an exemplary embodiment of the present specification may include that an internal region of the micelle formed by the one or more surfactants is formed to have a hollow portion.

The shell or shell portion in the present specification may mean a metal layer constituting a metal nanoparticle including the one or more bowl-type particles. Specifically, the following shell or shell portion may mean a metal nanoparticle including the one or more bowl-type particles.

According to an exemplary embodiment of the present specification, the metal nanoparticle may be in a form in which a portion of the shell portion of a metal nanoparticle composed of a hollow core and a metal shell is removed.

According to an exemplary embodiment of the present specification, the forming of the solution may include a step in which one or more surfactants form micelles in a solution. Specifically, according to an exemplary embodiment of the present specification, the forming of the solution may include a step in which a first surfactant and a second surfactant form micelles in a solution.

According to an exemplary embodiment of the present specification, the one or more metal ions or the atomic group ion including the metal ion may form the shell portion of the metal nanoparticle. Specifically, according to an exemplary embodiment of the present specification, a first metal ion or an atomic group ion including the first metal ion; and a second metal ion or an atomic group ion including the second metal ion may form a shell portion of the metal nanoparticle.

According to an exemplary embodiment of the present specification, the forming of the metal nanoparticles may be forming the bowl-type particles by bonding the metal ion or the atomic group ion including the metal ion to a portion of an outer surface for the micelle and reducing the metal ion or the atomic group ion including the metal ion.

According to an exemplary embodiment of the present specification, the halide provides a halogen ion in the solvent, and the halogen ion may be bonded to a portion of an outer surface of the micelle to suppress the metal ion or the atomic group ion including the metal ion from being bonded to the portion of the outer surface of the micelle.

Specifically, the halogen ion may serve to be bonded to a portion of an outer surface of the micelle to prevent a metal layer from being partially formed, thereby forming bowl-type particles.

According to an exemplary embodiment of the present specification, the halide may mean a metal halide. More specifically, according to an exemplary embodiment of the present specification, the halide may mean a halide of an alkali metal or alkaline earth metal.

Specifically, according to an exemplary embodiment of the present specification, the halide may include one or more selected from the group consisting of LiF, LiCl, LiBr, LiI, NaCl, NaBr, NaI, KCl, KBr, KI, $MgCl_2$, $MgBr_2$, $MgI_2$, $CaCl_2$, $CaBr_2$, and $CaI_2$.

According to an exemplary embodiment of the present specification, the concentration of the halide may be 2.5 times or less the concentration of the metal salt to the solvent. Specifically, the concentration of the halide may be more than 0 time and 2.5 times or less the concentration of the metal salt to the solvent.

When the concentration of the halide is within the range, a metal nanoparticle including one or more bowl-type particles may be smoothly formed.

According to an exemplary embodiment of the present specification, the amino acid may serve to prevent metal nanoparticles from being aggregated with each other. In addition, the amino acid may serve to allow the metal nanoparticles to be formed to have a small and uniform particle diameter.

According to an exemplary embodiment of the present specification, the concentration of the amino acid may be 2.5 times or less the concentration of the metal salt to the solvent. Specifically, the concentration of the amino acid may be more than 0 time and 2.5 times or less the concentration of the metal salt to the solvent.

When the concentration of the amino acid is within the range, it is possible to prevent metal nanoparticles from being aggregated, and to serve to make the particle diameter of the metal nanoparticle small. Specifically, when the concentration of the amino acid is within the range, the ratio at which two or more particles are synthesized in an aggregated form may be significantly reduced, and metal nanoparticles having a particle diameter of 10 nm or less may be synthesized.

According to an exemplary embodiment of the present specification, the surfactant may be one or two surfactant(s).

Specifically, when the surfactant is one surfactant, the surfactant forms micelles in a solution, and a halogen ion due to a halide may be bonded to a portion of an outer side surface of the micelle.

According to an exemplary embodiment of the present specification, the surfactant includes a first surfactant and a second surfactant, a bowl-type particle is formed in a form of an outer side surface of a micelle which the first surfactant forms, and a cavity may be formed in a micelle region which the second surfactant forms.

According to an exemplary embodiment of the present specification, the halide provides a halogen ion in a solution, and the halogen ion may allow the micelle region to be formed of a cavity as in the second surfactant.

According to an exemplary embodiment of the present specification, an internal region of a micelle which the first surfactant forms may be formed to have a hollow portion, and a metal layer may be formed on an outer side surface of a micelle which a first surfactant, to which the halogen ion is not bonded, forms, thereby forming a bowl-type nanoparticle.

According to an exemplary embodiment of the present specification, a metal layer is not formed in a micelle region which the second surfactant forms, so that the micelle region may be an empty space of a bowl-type particle.

The cavity of the present specification may mean an empty space which does not form a shell portion. Specifically, when the metal nanoparticle includes a hollow portion, the cavity may be an empty space extending from the outer surface of the shell portion to the hollow portion.

The metal nanoparticle of the present specification in the form of the bowl-type particle or in the form in which two or more bowl-type particles are partially brought into contact with each other may mean that the size of the cavities occupies 30% or more of the entire shell portion.

Further, the metal nanoparticle in the form in which the two or more bowl-type particles are partially brought into contact with each other may mean a form in which the cavities are continuously formed, and thus the metal nanoparticles are partially split.

In addition, the bowl-type particle may mean that the cavities are continuously formed, and thus 30% or more of the surface of the nanoparticle does not form a shell portion.

According to an exemplary embodiment of the present specification, the cavity may be formed by adjusting the concentration; the chain length; the size of the outer end portion; or the type of charge, of the second surfactant.

According to an exemplary embodiment of the present specification, the first surfactant may serve to form micelles in a solution to allow the metal ion or the atomic group ion including the metal ion to form a shell portion, and the second surfactant may serve to form the cavity of the metal nanoparticle.

According to an exemplary embodiment of the present specification, the preparation method may include forming the shell portion of the metal nanoparticle in a micelle region which the first surfactant forms, and forming the cavity of the metal nanoparticle in a micelle region which the second surfactant forms.

According to an exemplary embodiment of the present specification, the forming of the solution may include adjusting the size or number of the cavities by varying the concentrations of the first and second surfactants. Specifically, according to an exemplary embodiment of the present specification, the molar concentration of the second surfactant may be 0.01 to 1 time the molar concentration of the first surfactant. Specifically, the molar concentration of the second surfactant may be 1/30 to 1 time the molar concentration of the first surfactant.

According to an exemplary embodiment of the present specification, the first surfactant and the second surfactant in the forming of the solution may form micelles depending on the concentration ratio. The size of the cavities or the number of the cavities in the metal nanoparticle may be adjusted by adjusting the molar concentration ratio of the first surfactant to the second surfactant. Furthermore, a metal nanoparticle including one or more bowl type particles may also be prepared by allowing the cavities to be continuously formed.

Further, according to an exemplary embodiment of the present specification, the forming of the solution may include adjusting the size of the cavity by adjusting the size of the outer end portion of the second surfactant.

In addition, according to an exemplary embodiment of the present specification, the forming of the solution may include forming a cavity in the second surfactant region by adjusting the chain length of the second surfactant to be different from the chain length of the first surfactant.

According to an exemplary embodiment of the present specification, the chain length of the second surfactant may be 0.5 to 2 times the chain length of the first surfactant. Specifically, the chain length may be determined by the number of carbon atoms.

According to an exemplary embodiment of the present specification, it is possible to allow a metal salt bonded to the outer end portion of the second surfactant so as not to form the shell portion of the metal nanoparticle by making the chain length of the second surfactant different from the chain length of the first surfactant.

Furthermore, according to an exemplary embodiment of the present specification, the forming of the solution may include forming a cavity by adjusting the charge of the second surfactant to be different from the charge of the first surfactant.

According to an exemplary embodiment of the present specification, a first metal ion or an atomic group ion including the first metal ion, which has a charge opposite to the first and second surfactants, may be positioned at the outer end portions of the first and second surfactants, which form micelles in the solvent. Further, the second metal ion opposite to the charge of the first metal ion may be positioned on the outer surface of the first metal ion.

According to an exemplary embodiment of the present specification, the first metal ion and the second metal ion, which are formed at the outer end portion of the first surfactant, may form the shell portion of the metal nanoparticle, and the first metal ion and the second metal ion, which are positioned at the outer end portion of the second surfactant, do not form the shell and may form a cavity.

According to an exemplary embodiment of the present specification, when the first surfactant is an anionic surfactant, the first surfactant forms micelles in the forming of the solution, and the micelle may be surrounded by cations of the first metal ion or the atomic group ion including the first metal ion. Furthermore, the atomic group ion including the second metal ion of the anion may surround the cations. Furthermore, in the forming of the metal nanoparticle by adding a reducing agent, the cations surrounding the micelle forms a first shell, and the anions surrounding the cations may form a second shell.

In addition, according to an exemplary embodiment of the present specification, when the first surfactant is a cationic surfactant, the first surfactant forms micelles in the forming of the solution, and the micelle may be surrounded by anions of the atomic group ion including the first metal ion. Furthermore, the second metal ion of the cation or the atomic group ion including the second metal ion may surround the anions. Furthermore, in the forming of the metal nanoparticle by adding a reducing agent, the anions surrounding the micelle form a first shell, and the cations surrounding the anions may form a second shell.

According to an exemplary embodiment of the present specification, the forming of the metal nanoparticle may include forming the first and second surfactant regions, which form the micelles, to have a hollow portion.

According to an exemplary embodiment of the present specification, both the first surfactant and the second surfactant may be a cationic surfactant.

Alternatively, according to an exemplary embodiment of the present specification, both the first surfactant and the second surfactant may be an anionic surfactant.

According to an exemplary embodiment of the present specification, when both the first surfactant and the second surfactant have the same charge, a micelle may be formed by making the chain length of the second surfactant different from the chain length of the first surfactant.

Specifically, by a difference in chain lengths of the second surfactant, the first and second metal ions positioned at the outer end portion of the second surfactant are not adjacent to the first and second metal ions positioned at the outer end portion of the first surfactant, and thus, do not form the shell portion.

According to an exemplary embodiment of the present specification, the concentration of the first surfactant may be 1 time to 5 times the critical micelle concentration to the solvent.

According to an exemplary embodiment of the present specification, the first metal ion or the atomic group ion including the first metal ion has a charge which is opposite to a charge at the outer end portion of the first surfactant, and the second metal ion or the atomic group ion including the second metal ion may have a charge which is the same as the charge at the outer end portion of the first surfactant.

Therefore, the first metal ion or the atomic group ion including the first metal ion is positioned at the outer end portion of the first surfactant which forms micelles in the solution, thereby producing a form which surrounds the outer surface of the micelle. Furthermore, the second metal ion or the atomic group ion including the second metal ion surrounds the outer surface of the first metal ion or the atomic group ion including the first metal ion. The first metal salt and the second metal salt may form a shell portion including the first metal and the second metal, respectively, by a reducing agent.

The outer end portion of the surfactant in the present specification may mean the outer side portion of the micelle of the first or second surfactant which forms the micelle. The outer end portion of the surfactant of the present specification may mean the head of the surfactant. Further, the outer end portion of the present specification may determine the charge of the surfactant.

In addition, the surfactant of the present specification may be classified into an ionic surfactant or a non-ionic surfactant depending on the type of the outer end portion, and the ionic surfactant may be a cationic surfactant, an anionic surfactant, a zwitterionic surfactant or an amphoteric surfactant. The zwitterionic surfactant contains both positive and negative charges. If the positive and negative charges in the surfactant of the present specification are dependent on the pH, the surfactant may be an amphoteric surfactant, which may be zwitterionic in a certain pH range. Specifically, in the present specification, the anionic surfactant may mean that the outer end portion of the surfactant is negatively charged, and the cationic surfactant may mean that the outer end portion of the surfactant is positively charged.

According to an exemplary embodiment of the present specification, the surfactant may include one or more selected from the group consisting of a cationic surfactant, an anionic surfactant, a non-ionic surfactant, and a zwitterionic surfactant.

FIGS. 3 and 4 illustrate examples of the cross-section of the metal nanoparticle formed by the preparation method of the present specification. FIGS. 3 and 4 exemplify that the metal nanoparticle is prepared by using an anionic surfactant as the first surfactant and a non-ionic surfactant as the second surfactant.

Specifically, FIG. 3 illustrates a metal nanoparticle in which two bowl-type particles are brought into contact with each other. That is, the shell portion is not formed in a region where the second surfactant is continuously distributed, and the second surfactant is distributed in a very small amount in a portion where the bowl-type particles are brought into contact with each other, and thus, the shell portion is not completely formed and the bowl-type particles are brought into contact with each other.

Further, FIG. 4 illustrates a metal nanoparticle composed of one bowl-type particle. That is, the shell portion is not formed in a region where the second surfactant is continuously distributed, and thus, a bowl-type metal nanoparticle is formed.

According to an exemplary embodiment of the present specification, the first surfactant may be an anionic surfactant or a cationic surfactant, and the second surfactant may be a non-ionic surfactant.

According to an exemplary embodiment of the present specification, when the second surfactant is a non-ionic surfactant, the cavity of the metal nanoparticle may be formed because the metal ion is not positioned at the outer end portion of the second surfactant. Therefore, when the second surfactant is non-ionic, the cavity of the metal nanoparticle may be formed even when the length of the chain of the second surfactant is the same as or different from that of the first surfactant.

According to an exemplary embodiment of the present specification, the first surfactant may be an anionic surfactant or a cationic surfactant, and the second surfactant may be a zwitterionic surfactant.

According to an exemplary embodiment of the present specification, when the second surfactant is a zwitterionic surfactant, the cavity of the metal nanoparticle may be formed because the metal ion is not positioned at the outer end portion of the second surfactant. Therefore, when the second surfactant is zwitterionic, the cavity of the metal nanoparticle may be formed even when the length of the chain of the second surfactant is the same as or different from that of the first surfactant.

The anionic surfactant of the present specification may be selected from the group consisting of ammonium lauryl sulfate, sodium 1-heptanesulfonate, sodium hexanesulfonate, sodium dodecyl sulfate, triethanol ammonium dodecylbenzenesulfate, potassium laurate, triethanolamine stearate, lithium dodecyl sulfate, sodium lauryl sulfate, alkyl polyoxyethylene sulfate, sodium alginate, dioctyl sodium sulfosuccinate, phosphatidylglycerol, phosphatidylinositol, phosphatidylserine, phosphatidic acid and salts thereof, glyceryl esters, sodium carboxymethylcellulose, bile acids and salts thereof, cholic acid, deoxycholic acid, glycocholic acid, taurocholic acid, glycodeoxycholic acid, alkyl sulfonate, aryl sulfonate, alkyl phosphate, alkyl phosphonate, stearic acid and salts thereof, calcium stearate, phosphate, carboxymethylcellulose sodium, dioctyl sulfosuccinate, dialkyl esters of sodium sulfosuccinate, phospholipids, and calcium carboxymethylcellulose. However, the anionic surfactant is not limited thereto.

The cationic surfactant of the present specification may be selected from the group consisting of quaternary ammonium compounds, benzalkonium chloride, cetyltrimethylammonium bromide, chitosan, lauryldimethylbenzylammonium chloride, acyl carnitine hydrochloride, alkyl pyridinium halide, cetyl pyridinium chloride, cationic lipids, polymethylmethacrylate trimethylammonium bromide, sulfonium compounds, polyvinylpyrrolidone-2-dimethylaminoethyl methacrylate dimethyl sulfate, hexadecyltrimethyl ammonium bromide, phosphonium compounds, benzyl-di(2-chloroethyl)ethylammonium bromide, coconut trimethyl ammonium chloride, coconut trimethyl ammonium bromide, coconut methyl dihydroxyethyl ammonium chloride, coconut methyl dihydroxyethyl ammonium bromide, decyl triethyl ammonium chloride, decyl dimethyl hydroxyethyl ammonium chloride bromide, ($C_{12}$-$C_{15}$)dimethyl hydroxyethyl ammonium chloride, ($C_{12}$-$C_{15}$)dimethyl hydroxyethyl ammonium chloride bromide, coconut dimethyl hydroxyethyl ammonium chloride, coconut dimethyl hydroxyethyl ammonium bromide, myristyl trimethyl ammonium methyl sulfate, lauryl dimethyl benzyl ammonium chloride, lauryl dimethyl benzyl ammonium bromide, lauryl dimethyl (ethenoxy)$_4$ ammonium chloride, lauryl dimethyl (ethenoxy)$_4$ ammonium bromide, N-alkyl ($C_{12-18}$)dimethylbenzyl ammonium chloride, N-alkyl ($C_{14-18}$)dimethyl-benzyl ammonium chloride, N-tetradecylidimethylbenzyl ammonium chloride monohydrate, dimethyl didecyl ammonium chloride, N-alkyl ($C_{12-14}$)dimethyl 1-napthylmethyl ammonium chloride, trimethylammonium halide alkyl-trimethylammonium salts, dialkyl-dimethylammonium salts, lauryl trimethyl ammonium chloride, ethoxylated alkyamidoalkyldialkylammonium salts, ethoxylated trialkyl ammonium salts, dialkylbenzene dialkylammonium chloride, N-didecyldimethyl ammonium chloride, N-tetradecyldimethylbenzyl ammonium chloride monohydrate, N-alkyl($C_{12-14}$) dimethyl 1-naphthylmethyl ammonium chloride, dodecyldimethylbenzyl ammonium chloride, dialkyl benzenealkyl ammonium chloride, lauryl trimethyl ammonium chloride, alkylbenzyl methyl ammonium chloride, alkyl benzyl dimethyl ammonium bromide, $C_{12}$ trimethyl ammonium bromide, $C_{15}$ trimethyl ammonium bromide, $C_{12}$ trimethyl ammonium bromides, dodecylbenzyl triethyl ammonium chloride, poly-diallyldimethylammonium chloride, dimethyl ammonium chloride, alkyldimethylammonium halogenide, tricetyl methyl ammonium chloride, decyltrimethylammonium bromide, dodecyltriethylammonium bromide, tetradecyltrimethylammonium bromide, methyl trioctylammonium chloride, POLYQUAT 10, tetrabutylammonium bromide, benzyl trimethylammonium bromide, choline esters, benzalkonium chloride, stearalkonium chloride, cetyl pyridinium bromide, cetyl pyridinium chloride, halide salts of quaternized polyoxyethylalkylamines, "MIRAPOL" (polyquaternium-2), "Alkaquat" (alkyl dimethyl benzylammonium chloride, manufactured by Rhodia), alkyl pyridinium salts, amines, amine salts, imide azolinium salts, protonated quaternary acrylamides, methylated quaternary polymers, cationic guar gum, benzalkonium chloride, dodecyl trimethyl ammonium bromide, triethanolamine, and poloxamines. However, the cationic surfactant is not limited thereto.

The non-ionic surfactant of the present specification may be selected from the group consisting of SPAN 60, polyoxyethylene fatty alcohol ethers, polyoxyethylene sorbitan fatty acid esters, polyoxyethylene fatty acid esters, polyoxyethylene alkyl ethers, polyoxyethylene castor oil derivatives, sorbitan esters, glyceryl esters, glycerol monostearate, polyethylene glycols, polypropylene glycols, polypropylene glycol esters, cetyl alcohol, cetostearyl alcohol, stearyl alcohol, aryl alkyl polyether alcohols, polyoxyethylene-polyoxypropylene copolymers, poloxamers, poloxamines, methylcellulose, hydroxycellulose, hydroxymethylcellulose, hydroxyethylcellulose, hydroxypropylcellulose, hydroxypropylmethylcellulose, hydroxypropylmethylcellulose phthalate, non-crystalline cellulose, polysaccharides, starch, starch derivatives, hydroxyethyl starch, polyvinyl alcohol, triethanolamine stearate, amine oxide, dextran, glycerol, gum acacia, cholesterol, tragacanth, and polyvinylpyrrolidone.

The zwitterionic surfactant of the present specification may be selected from the group consisting of N-dodecyl-N, N-dimethyl-3-ammonio-1-propanesulfonate, betaine, alkyl betaine, alkylamido betaine, amido propyl betaine, cocoampho carboxy glycinate, sarcosinate aminopropionate, aminoglycinate, imidazolinium betaine, amphoteric imidazoline, N-alkyl-N,N-dimethylammonio-1-propanesulfonates, 3-cholamido-1-propyldimethylammonio-1-propanesulfonate, dodecylphosphocholine, and sulfo-betaine. However, the zwitterionic surfactant is not limited thereto.

According to an exemplary embodiment of the present specification, the concentration of the first surfactant may be 1 time to 5 times the critical micelle concentration to the solvent. Specifically, the concentration of the first surfactant may be 2 times the critical micelle concentration to the solvent.

The critical micelle concentration (CMC) in the present specification means the lower limit of the concentration at which the surfactant forms a group (micelle) of molecules or ions in a solution.

The most important characteristics of the surfactant are that the surfactant tends to be adsorbed on an interface, for example, an air-liquid interface, an air-solid interface, and a liquid-solid interface. When the surfactants are free in the sense of not being present in an aggregated form, they are referred to as monomers or unimers, and when the unimer concentration is increased, they are aggregated to form small entities of aggregates, that is, micelles. The concentration may be referred to as the critical micelle concentration.

When the concentration of the first surfactant is less than 1 time the critical micelle concentration, the concentration of the first surfactant to be adsorbed on the first metal salt may be relatively decreased. Accordingly, the amount of core particles to be formed may also be entirely decreased. Meanwhile, when the concentration of the first surfactant exceeds 5 times the critical micelle concentration, the concentration of the first surfactant is relatively increased, so that metal nanoparticles which form a hollow core, and metal particles which do not form a hollow core may be mixed, and thus, aggregated. Therefore, when the concentration of the first surfactant is 1 time to 5 times the critical micelle concentration to the solvent, the metal nanoparticles may be smoothly formed.

According to an exemplary embodiment of the present specification, the size of the metal nanoparticles may be adjusted by adjusting the first surfactant which forms the micelle, and/or the first and second metal salts which surround the micelle.

According to an exemplary embodiment of the present specification, the size of the metal nanoparticles may be adjusted by the chain length of the first surfactant which forms the micelle. Specifically, when the chain length of the first surfactant is short, the size of the micelle becomes small, and accordingly, the size of the metal nanoparticles may be decreased.

According to an exemplary embodiment of the present specification, the number of carbon atoms of the chain of the first surfactant may be 15 or less. Specifically, the number of carbon atoms of the chain may be 8 to 15. Alternatively, the number of carbon atoms of the chain may be 10 to 12.

According to an exemplary embodiment of the present specification, the size of the metal nanoparticles may be adjusted by adjusting the type of counter ion of the first surfactant which forms the micelle. Specifically, the larger the size of the counter ion of the first surfactant is, the weaker the binding force of the outer end portion of the first surfactant to the head portion is, so that the size of the micelle may be increased, and accordingly, the size of the metal nanoparticles may be increased.

According to an exemplary embodiment of the present specification, when the first surfactant is an anionic surfactant, the first surfactant may include $NH_4^+$, $K^-$, $Na^+$, or $Li^+$ as the counter ion.

Specifically, the size of the metal nanoparticles may be decreased in the order of the case where the counter ion of the first surfactant is $NH_4^+$, the case where the counter ion of the first surfactant is $K^+$, the case where the counter ion of the first surfactant is $Na^+$, and the case where the counter ion of the first surfactant is $Li^+$.

According to an exemplary embodiment of the present specification, when the first surfactant is a cationic surfactant, the first surfactant may include $I^-$, $Br^-$, or $Cl^-$ as the counter ion.

Specifically, the size of the metal nanoparticles may be decreased in the order of the case where the counter ion of the first surfactant is $I^-$, the case where the counter ion of the first surfactant is $Br^-$, and the case where the counter ion of the first surfactant is $Cl^-$.

According to an exemplary embodiment of the present specification, the size of the metal nanoparticles may be adjusted by adjusting the size of the head portion of the outer end portion of the first surfactant which forms the micelle. Furthermore, when the size of the head portion of the first surfactant formed on the outer surface of the micelle is increased, the repulsive force between head portions of the first surfactant is increased, so that the micelle may be increased, and accordingly, the size of the metal nanoparticles may be increased.

According to an exemplary embodiment of the present specification, the aforementioned factors compositely act, so that the size of the metal nanoparticles may be determined.

According to an exemplary embodiment of the present specification, the metal salt is not particularly limited as long as the metal salt may be ionized in a solution to provide metal ions. The metal salt may be ionized in the solution state to provide a cation including a metal ion or an anion of an atomic group ion including the metal ion.

The method for preparing a metal nanoparticle according to an exemplary embodiment of the present specification does not use the reduction potential difference and thus has an advantage in that the reduction potential between one or two or more metal ions, which form shells, is not considered.

The preparation method of the present specification uses charges among metal ions and thus is simpler than the methods for preparing a metal nanoparticle, which uses the reduction potential difference in the related art. Therefore, the method for preparing a metal nanoparticle according to the present specification facilitates the mass production, and may prepare the metal nanoparticle at low costs. Furthermore, the method does not use the reduction potential difference and thus has an advantage in that various metal salts may be used because the limitation of the metal salt to be used is reduced as compared to the methods for preparing a metal nanoparticle in the related art.

According to an exemplary embodiment of the present specification, the concentration of the metal salt may be 0.1 mM to 0.5 mM to the solvent.

When the concentration of the metal salt is within the range, a metal nanoparticle including one or more bowl-type particles may be smoothly formed. When the concentration of the metal salt exceeds the range, there is a problem in that metal nanoparticles having a uniform size, which include one or more bowl-type particles, may not be well synthesized, and particles are aggregated with each other to form a large amorphous particle.

According to an exemplary embodiment of the present specification, the metal salt may be two or more metal salts which provide different metal ions or an atomic group ion including the metal ion. Specifically, the solution may include two metal salts, and a first metal salt and a second metal salt to be included in the solution may be different from each other. More specifically, the first metal salt may provide a cation including a metal ion, and the second metal salt may provide an anion of an atomic group ion including the metal ion. Specifically, the first metal salt may provide a cation of $Ni^{2+}$, and the second metal salt may provide an anion of $PtCl_4^{2-}$.

According to an exemplary embodiment of the present specification, the metal salt may be a salt including those selected from the group consisting of metals which belong to Groups 3 to 15 of the periodic table, metalloids, lanthanide metals, and actinide metals.

According to an exemplary embodiment of the present specification, the metal salt may be each a nitrate, a halide, a hydroxide or a sulfate of the metal.

According to an exemplary embodiment of the present specification, specifically, the one or two or more metal salts are different from each other, and may be each independently a salt of a metal selected from the group consisting of platinum (Pt), ruthenium (Ru), rhodium (Rh), molybdenum (Mo), osmium (Os), iridium (Ir), rhenium (Re), palladium (Pd), vanadium (V), tungsten (W), cobalt (Co), iron (Fe), selenium (Se), nickel (Ni), bismuth (Bi), tin (Sn), chromium (Cr), titanium (Ti), gold (Au), cerium (Ce), silver (Ag), and copper (Cu).

Specifically, according to an exemplary embodiment of the present specification, the metal salt may at least include a salt of platinum (Pt). Further, according to an exemplary embodiment of the present specification, the metal salt may include one or more selected from the group consisting of a salt of platinum (Pt), a salt of nickel (Ni), and a salt of cobalt (Co).

According to an exemplary embodiment of the present specification, the molar ratio of the first metal salt to the second metal salt in the forming of the solution may be 1:5 to 10:1. Specifically, the molar ratio of the first metal salt to the second metal salt may be 2:1 to 5:1.

When the number of moles of the first metal salt is smaller than the number of moles of the second metal salt, it is difficult for a first metal ion to form a first shell including a hollow portion. Further, when the number of moles of the first metal salt is more than 10 times the number of moles of the second metal salt, it is difficult for a second metal ion to form a second shell surrounding a first shell. Therefore, the first and second metal ions may smoothly form a shell portion of the metal nanoparticles in the range.

According to an exemplary embodiment of the present specification, the forming of the solution may further include further adding a stabilizer.

The stabilizer may be, for example, one or a mixture of two or more selected from the group consisting of disodium phosphate, dipotassium phosphate, disodium citrate, and trisodium citrate.

According to an exemplary embodiment of the present specification, the forming of the metal nanoparticle may include further adding a non-ionic surfactant together with the reducing agent.

The non-ionic surfactant is adsorbed on the surface of the shell and thus serves to uniformly disperse the metal nanoparticles formed in the solution. Therefore, the non-ionic surfactant may prevent metal particles from being conglomerated or aggregated to be precipitated and allow metal nanoparticles to be formed in a uniform size. Specific examples of the non-ionic surfactant are the same as the above-described examples of the non-ionic surfactant.

According to an exemplary embodiment of the present specification, the solvent may be a solvent including water. Specifically, according to an exemplary embodiment of the present application, the solvent serves to dissolve the first metal salt and the second metal salt, and may be water or a mixture of water and a $C_1$ to $C_6$ alcohol, and more specifically, water. Since the preparation method according to the present specification does not use an organic solvent as the solvent, a post-treatment process of treating an organic solvent in the preparation process is not needed, and accordingly, there are effects of reducing costs and preventing environmental pollution.

According to an exemplary embodiment of the present specification, the preparation method may be carried out at normal temperature. The preparation method may be carried out at specifically 4° C. to 35° C., and more specifically 12° C. to 28° C.

The forming of the solution in an exemplary embodiment of the present specification may be carried out at normal temperature, specifically 4° C. to 35° C., and more specifically 12° C. to 28° C. When an organic solvent is used as the solvent, there is a problem in that the preparation needs to be performed at a high temperature exceeding 100° C. Since the preparation may be carried out at normal temperature, the present application is advantageous in terms of process due to a simple preparation method, and has a significant effect of reducing costs.

According to an exemplary embodiment of the present specification, the forming of the metal nanoparticle including the cavity by adding a reducing agent and/or a non-ionic surfactant to the solution may also be carried out at normal temperature, specifically 4° C. to 35° C., and more specifically 12° C. to 28° C. Since the preparation method of the present specification may be carried out at normal temperature, the method is advantageous in terms of process due to a simple preparation method, and has a significant effect of reducing costs.

According to an exemplary embodiment of the present specification, the reducing agent may have a standard reduction potential of −0.23 V or less.

The reducing agent is not particularly limited as long as the reducing agent is a strong reducing agent having a standard reduction potential of −0.23 V or less, specifically from −4 V to −0.23 V, and has a reducing power which may reduce the dissolved metal ions to be precipitated as metal particles. Specifically, the reducing agent may be at least one selected from the group consisting of $NaBH_4$, $NH_2NH_2$, $LiAlH_4$, and LiBEt3H.

When a weak reducing agent is used, a reaction speed is slow and a subsequent heating of the solution is required, so that it is difficult to achieve a continuous process, and thus, there may be a problem in terms of mass production, and particularly, when ethylene glycol, which is one of the weak reducing agents, is used, there is a problem in that the productivity is low in a continuous process due to a decrease in flow rate caused by high viscosity. Therefore, when the reducing agent of the present specification is used, it is possible to overcome the problem.

According to an exemplary embodiment of the present specification, the preparation method may further include, after the forming of the metal nanoparticle or after the removing of the surfactant inside the cavity, removing a cationic metal by adding an acid to the metal nanoparticle. When the acid is added to the metal nanoparticle in this step, a 3d band metal is eluted. The cationic metal may be specifically selected from the group consisting of ruthenium (Ru), rhodium (Rh), molybdenum (Mo), osmium (Os), iridium (Ir), rhenium (Re), palladium (Pd), vanadium (V), tungsten (W), cobalt (Co), iron (Fe), selenium (Se), nickel (Ni), bismuth (Bi), tin (Sn), chromium (Cr), titanium (Ti), cerium (Ce), silver (Ag), and copper (Cu).

According to an exemplary embodiment of the present specification, the acid is not particularly limited, and for example, it is possible to use an acid selected from the group consisting of sulfuric acid, nitric acid, hydrochloric acid, perchloric acid, hydroiodic acid, and hydrobromic acid.

According to an exemplary embodiment of the present specification, the bowl-type particle may have a particle diameter of 1 nm to 20 nm, and specifically, according to an exemplary embodiment of the present specification, the bowl-type particle may have a particle diameter of 1 nm to 15 nm. More specifically, the bowl-type particle may have a particle diameter of 3 nm to 10 nm.

When the metal nanoparticle has a particle diameter of 20 nm or less, there is an advantage in that the nanoparticle may be used in various fields. In addition, when the metal nanoparticle has a particle diameter of 10 nm or less, the surface area of the particle is further widened, so that there is an advantage in that the applicability of using the metal nanoparticles in various fields is further increased. For example, when the hollow metal nanoparticles formed in the range of the particle diameter are used as a catalyst, the efficiency may be significantly increased.

According to an exemplary embodiment of the present specification, the particle diameter of the metal nanoparticle may be in a range of 80% to 120% of the average particle diameter of the metal nanoparticles. Specifically, the particle diameter of the metal nanoparticle may be in a range of 90% to 110% of the average particle diameter of the metal nanoparticles. When the particle diameter exceeds the range, the size of the metal nanoparticles becomes non-uniform as a whole, so that it may be difficult to secure unique physical property values required for the metal nanoparticles. For example, when metal nanoparticles exceeding a range of 80% to 120% of the average particle diameter of the metal nanoparticles are used as a catalyst, the activity of the catalyst may become a little insufficient.

The particle diameter of the bowl-type particle of the present specification may mean the longest straight line distance from one end region of the bowl-type particle to another region. Alternatively, the particle diameter of the bowl-type particle may mean a particle diameter of a virtual sphere including the bowl-type particle.

According to the method for preparing a metal nanoparticle according to an exemplary embodiment of the present specification, it is possible to prepare one or more metal nanoparticles including the one or more bowl-type particles.

Further, according to the method for preparing a metal nanoparticle according to an exemplary embodiment of the present specification, it is possible to prepare a metal nanoparticle including the one or more bowl-type particles at a high yield.

Specifically, according to the method for preparing a metal nanoparticle according to an exemplary embodiment of the present specification, a metal nanoparticle including the one or more bowl-type particles may be prepared at a yield of 70% or more. More specifically, according to the preparation method according to an exemplary embodiment of the present specification, a metal nanoparticle including the one or more bowl-type particles may be prepared at a yield of 80% or more.

According to an exemplary embodiment of the present specification, the bowl-type particle may have a thickness of more than 0 nm and 5 nm or less. Specifically, the bowl-type particle may have a thickness of more than 0 nm and 3 nm or less.

In the present specification, the thickness of the bowl-type particle may mean a thickness of the metal layer constituting the bowl-type particle.

According to an exemplary embodiment of the present specification, the metal nanoparticle may include two or more different metals. Specifically, according to an exemplary embodiment of the present specification, the metal nanoparticle may include two or three different metals. Specifically, the metal nanoparticle may include a metal in which the metal ion included in the metal salt is reduced.

The metal nanoparticles of the present specification may be used while replacing existing nanoparticles in the field in which nanoparticles may be generally used. The metal nanoparticles of the present specification have much smaller sizes and wider specific surface areas than the nanoparticles in the related art, and thus may exhibit better activity than the nanoparticles in the related art. Specifically, the metal nanoparticles of the present specification may be used in various fields such as a catalyst, drug delivery, and a gas sensor. The metal nanoparticles may also be used as a catalyst, or as an active material formulation in cosmetics, pesticides, animal nutrients, or food supplements, and may also be used as a pigment in electronic products, optical elements, or polymers.

MODE FOR INVENTION

Hereinafter, the present specification will be described in detail with reference to the Examples for specifically describing the present specification. However, the Examples according to the present specification may be modified in various forms, and it is not interpreted that the scope of the present specification is limited to the Examples described below in detail. The Examples of the present specification are provided to more completely explain the present specification to a person with ordinary skill in the art.

Example 1

$Ni(NO_3)_2$ as a first metal salt, $K_2PtCl_4$ as a second metal salt, sodium hexanesulfonate as a first surfactant, ammonium lauryl sulfate (ALS) as a second surfactant, trisodium citrate as a stabilizer, glycine as an amino acid, and NaBr were added to distilled water to form a solution, and the solution was stirred for 30 minutes. In this case, the molar ratio of $K_2PtCl_4$ to $Ni(NO_3)_2$ was 1:3, and the molar concentration of ALS was ⅔ time the molar concentration of sodium hexanesulfonate. Further, the concentration of glycine was about 2.5 times the concentration of $K_2PtCl_4$, and the concentration of NaBr was about 20 times the concentration of $K_2PtCl_4$.

Subsequently, $NaBH_4$ as a reducing agent was added thereto, and the resulting mixture was reacted overnight.

Thereafter, the mixture was centrifuged at 14,000 rpm for 10 minutes to discard the supernatant in the upper layer, and then the remaining precipitate was re-dispersed in distilled water, and then the centrifugation process was repeated to prepare the metal nanoparticles of the specification of the present application. The process of preparing the metal nanoparticles was carried out under atmosphere of 14° C.

A transmission electron microscope (TEM) image of the metal nanoparticles, which were prepared according to Example 1, is illustrated in FIG. 5.

The average particle diameter of the metal nanoparticles according to Example 1 was 10 nm. In addition, the ratio of the metal nanoparticles including the bowl-type particle was about 80% or more.

Comparative Example 1

The metal nanoparticles were prepared in the same manner as in Example 1, except that a solution, which did not include glycine nor NaBr, was formed.

A transmission electron microscope (TEM) image of the metal nanoparticles, which were prepared according to Example 1, is illustrated in FIG. 6. According to FIG. 6, it can be seen that particles are aggregated with each other to form agglomerated particles in a large amount as indicated in the circle.

The average particle diameter of the metal nanoparticles according to Comparative Example 1 was 12 nm, and the ratio of the metal nanoparticles including the bowl-type particle was about 30%.

Comparative Example 2

The metal nanoparticles were prepared in the same manner as in Example 1, except that a solution, which did not include NaBr, was formed.

A transmission electron microscope (TEM) image of the metal nanoparticles, which were prepared according to Comparative Example 2, is illustrated in FIG. 7.

The average particle diameter of the metal nanoparticles according to Comparative Example 2 was 10 nm. However, the ratio of the metal nanoparticles including the bowl-type particle was about 55%.

According to the metal nanoparticles according to the Examples and the Comparative Examples, it can be seen that when metal nanoparticles are formed by using a solution including glycine which is an amino acid, the particle diameter of the metal nanoparticle becomes smaller, and thus, metal nanoparticles having a larger surface area are formed. Further, it can be seen that when metal nanoparticles are formed by using a solution including NaBr which is a halide, the yield of the bowl-type nanoparticles is significantly increased. Therefore, the metal nanoparticle according to the Example in which a solution including both an amino acid and a halide is used has an advantage in that metal nanoparticles including a bowl-type particle having a small particle diameter can be prepared at a high yield.

The invention claimed is:

1. A method for preparing a metal nanoparticle, the method comprising:

forming a solution comprising a solvent, a metal salt which provides a metal ion or an atomic group ion comprising the metal ion in the solvent, one or more surfactants which form micelles in the solvent, an amino acid, and a halide; and forming the metal nanoparticle by adding a reducing agent to the solution, wherein the metal nanoparticle comprises one or more bowl shaped particles comprising one or more metals.

2. The method of claim 1, wherein the forming of the metal nanoparticles is forming the particles by bonding the metal ion or the atomic group ion comprising the metal ion to a portion of an outer surface of the micelle and reducing the metal ion or the atomic group ion comprising the metal ion.

3. The method of claim 1, wherein the halide provides a halogen ion in the solvent, and the halogen ion is bonded to a portion of an outer surface of the micelle to suppress the metal ion or the atomic group ion comprising the metal ion from being bonded to the portion of the outer surface of the micelle.

4. The method of claim 1, wherein the surfactant comprises a first surfactant and a second surfactant, a particle is formed in a form of an outer side surface of a micelle which the first surfactant forms, and a cavity is formed in a micelle region which the second surfactant forms.

5. The method of claim 4, wherein the cavity is formed by adjusting a concentration; a chain length; a size of an outer end portion; or a type of charge, of the second surfactant.

6. The method of claim 4, wherein a concentration of the first surfactant is 1 time to 5 times a critical micelle concentration to the solvent.

7. The method of claim 4, wherein a molar concentration of the second surfactant is 0.01 time to 1 time a molar concentration of the first surfactant.

8. The method of claim 1, wherein the surfactant comprises one or more selected from a group consisting of a cationic surfactant, an anionic surfactant, a non-ionic surfactant, and a zwitterionic surfactant.

9. The method of claim 1, wherein the metal salt is two or more metal salts which provides different metal ions or the atomic group ion comprising the metal ion.

10. The method of claim 1, wherein the metal salt is a salt comprising a metal selected from a group consisting of metals which belong to Groups 3 to 15 of the periodic table, metalloids, lanthanide metals, and actinide metals.

11. The method of claim 1, wherein the metal salt is a metal nitrate, a metal halide, a metal hydroxide or a metal sulfate.

12. The method of claim 1, wherein a concentration of the metal salt is 0.1 mM to 0.5 mM to the solvent.

13. The method of claim 1, wherein a concentration of the amino acid is 2.5 times or less a concentration of the metal salt to the solvent.

14. The method of claim 1, wherein a concentration of the halide is 2.5 times or less the concentration of the metal salt to the solvent.

15. The method of claim 1, wherein the solvent comprises water.

16. The method of claim 1, wherein the preparation method is carried out at normal temperature.

17. The method of claim 1, wherein the metal nanoparticle is composed of the one or two particles.

18. The method of claim 1, wherein the particle has a particle diameter of 1 nm to 20 nm.

19. The method of claim 1, wherein the particle has a thickness of more than 0 nm and 5 nm or less.

20. The method of claim 1, wherein the metal nanoparticle comprises two or more different metals.

21. The method of claim 1, wherein the bowl shaped particles are particles comprising:

at least one curved line region included on a cross section of a particle; or a curved line region and a straight line region on a cross section of a particle; or a perfect or imperfect sphere from which a region has been removed; or a perfect or imperfect semispherical shape with a constant or inconstant radius of curvature in which a perfect or imperfect sphere is divided through its center; or a perfect or imperfect semispherical shape with a constant or inconstant radius of curvature in which a perfect or imperfect sphere is divided other than through its center; or a discontinuous region corresponding to 30% to 80% of a hollow particle body; or a discontinuous region corresponding to 30% to 80% of a particle entire shell.

* * * * *